US005393126A

United States Patent [19]

Boulva

[11] Patent Number: 5,393,126

[45] Date of Patent: Feb. 28, 1995

[54] TUBULAR FRAME SEATING STRUCTURE WITH TENSION SLEEVE

[75] Inventor: Paul Boulva, Piedmont, Canada

[73] Assignee: Art Design International Inc., St. Hubert, Canada

[21] Appl. No.: 79,525

[22] Filed: Jun. 21, 1993

[51] Int. Cl.[6] ..... A47C 7/02

[52] U.S. Cl. ..... 297/452.56; 297/440.11; 297/452.20

[58] Field of Search ..... 297/452.56, 440.11, 297/452.2

[56] References Cited

U.S. PATENT DOCUMENTS

| | | | |
|---|---|---|---|
| 3,604,752 | 9/1971 | Macknick | 297/452.2 |
| 4,583,783 | 4/1986 | Kanai | 297/452.56 |
| 4,761,035 | 8/1988 | Urai | 297/452.56 |
| 4,784,436 | 11/1988 | Sutherland | 297/440.11 |
| 4,842,257 | 6/1989 | Abu-Isa et al. | 297/452.56 |
| 4,890,882 | 1/1990 | Harrington | 297/440.11 |
| 4,910,817 | 3/1990 | Kita | 297/452.56 |
| 4,928,334 | 5/1990 | Kita | 297/452.56 |
| 5,013,089 | 5/1991 | Abu-Isa et al. | 297/452.56 |
| 5,058,949 | 10/1991 | Von Hoffman | 297/440.11 |

*Primary Examiner*—John T. Kwon

[57] ABSTRACT

A composite support frame structure for the construction of a seat. The support structure comprises a rigid continuous rod-like frame formed in a closed loop and having opposed diverging rod-like side members which lie in a common plane and opposed rod-like end members formed integral with the side members. At least one of the end members is arced outwardly. A belt of substantially non-extensible material forms a slightly truncated sleeve, narrower that the frame, to apply a compression force between the side members and to flex the arced end member. The sleeve is retained in tension about the opposed diverging rod-like side members by restoring spring force between the side members exerted by the arced end member.

20 Claims, 3 Drawing Sheets

TUBULAR FRAME SEATING STRUCTURE WITH TENSION SLEEVE

BACKGROUND OF THE INVENTION

1. Field of the Invention

The present invention relates to a composite support frame structure for the construction of a seat and/or backrest of a seating structure and wherein the support frame is formed of a rigid continuous rod-like frame forming a closed loop and wherein a belt having the shape of a truncated sleeve is retained with the seating portion suspended in tension in such a way that a person in seating posture could not contact any rigid element. A tensile force is applied to the sleeve by the side members of the frame which are placed in compression when the sleeve is positioned over the frame. The invention also relates to the fabrication of a seat structure incorporating the rod-like composite support structure.

2. Description of Prior Art

It is common in the construction of chairs or other types of small seating structures to find support frames being constructed of rigid panels which are formed or molded and on which a padded composite structure is secured, such as a shaped foam padding, and a fabric positioned thereover and clamped to the panel. The foam padding is usually shaped to provide comfort for the user. However, often the ischium bone of a person seated on the cushion will feel pressure by the solid structure under the padding. Other seating structures are also known wherein peripheral tubular frames are provided and a plurality of bands, of stretchable material, is secured thereto, such as plastic bands, which extend laterally or in a woven fashion and spanning the tubular members to form a frame structure. It is also known to provide a peripheral frame structure which defines a seating portion and a backrest portion with a tension bar interposed inside the frame. A sleeve of fabric material is slid over the frame from one end and the tension bar places it in tension to form a chair frame. Such a structure is, for example, disclosed in U.S. Pat. No. 3,600,035 issued to George's Vondrejs. With such a structure, there may be provided a single sleeve or two sleeves, one for the backrest and the other for the seating portion of the frame. However, with these structures, it is necessary to use a tension bar secured within the frame whereby to maintain the frame expanded to apply tension to the belts once they are slid into position on the frame. Furthermore, in order for the sleeve to be maintained in position, it is necessary to secure these sleeves is to attachment structures which are secured to the frame, such as wooden brackets, and the sleeve stapled or otherwise secured to the bracket to prevent it from moving. Again, the ischium bone or the buttocks of a person seated on the cushioned frame might feel some of the frame structure.

SUMMARY OF INVENTION

It is a feature of the present invention to provide a composite support frame structure wherein no tension bar or fasteners are required to maintain the sleeve in position about the frame which is formed by a rod-like member shaped in a closed loop and provided with diverging opposed side members which applies tension to the sleeve by a restoring force exerted by the frame due to a compression force provided by the sleeve.

According to a further feature of the present invention, there is provided a composite support frame structure formed from a rigid continuous rod-like frame defining a closed loop and wherein a sleeve of substantially non-extensible material is retained by a tensile restoring force exerted therein by the frame which is maintained in compression by the sleeve and wherein the support structure may be used to form the seat and/or backrest portion of a chair and wherein a person seated on a seating structure is supported spaced out of contact from the frame members.

According to a still further feature of the present invention, there is provided a method of constructing a seating structure comprising a composite support frame structure defining a closed loop formed from a rod-like member and positioning a substantially non-extensible belt about the frame to compress the frame and wherein the belt is maintained substantially immovable by tensile force exerted by the restoring force of the frame.

According to the above features, from a broad aspect, the present invention provides a composite support frame structure for the construction of a seat. The support frame structure comprises a rigid continuous rod-like frame formed in a closed loop and having opposed diverging side members lying in a common plane. The side members diverge towards a common end. A first intermediate end member is formed integral at one end of the opposed side members. A second intermediate end member is formed integral at an opposed end of the opposed diverging side members. At least one of the first and second intermediate end member has an outward arcuate shape to provide a restoring spring force in the frame when the diverging side members are compressed towards one another. A belt of substantially non-extensible material, forming a slightly truncated sleeve which is slightly smaller than the width of the rod-like frame, side disposed about the opposed diverging side members and span at least a portion of an open area defined inwardly of the frame. The sleeve, when in position about the frame, applies a compression force against the side members to flex the one of the first and second intermediate end member which is arced to apply a continuous restoring spring force in the frame between the side members to retain the sleeve in position by continuous tension.

According to a still further broad aspect of the present invention, there is provided a method of constructing a seating structure comprising the steps of providing a composite support frame structure formed by a rigid continuous rod-like frame defining a closed loop and having diverging frame side members and transverse frame end members whereby the frame is substantially a trapezoidal-shaped frame. At least one of the transverse end members has an outward arcuate shape to provide a restoring spring force in the support frame structure when the diverging side members are compressed towards one another. A belt of substantially non-extensible material, forming a slightly truncated-shaped sleeve, is positioned about the side members and spans at least a portion of an open area defined inwardly of the frame. The sleeve is slightly smaller than the width of the support frame structure whereby the side members are placed in compression towards one another by the sleeve when positioned thereabout to flex the one of the said first and second intermediate end members which is arced to apply a continuous restoring spring force in the support frame structure between the side members to maintain the sleeve stretched and substantially immovable across the open area by the said continuous restoring spring force.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
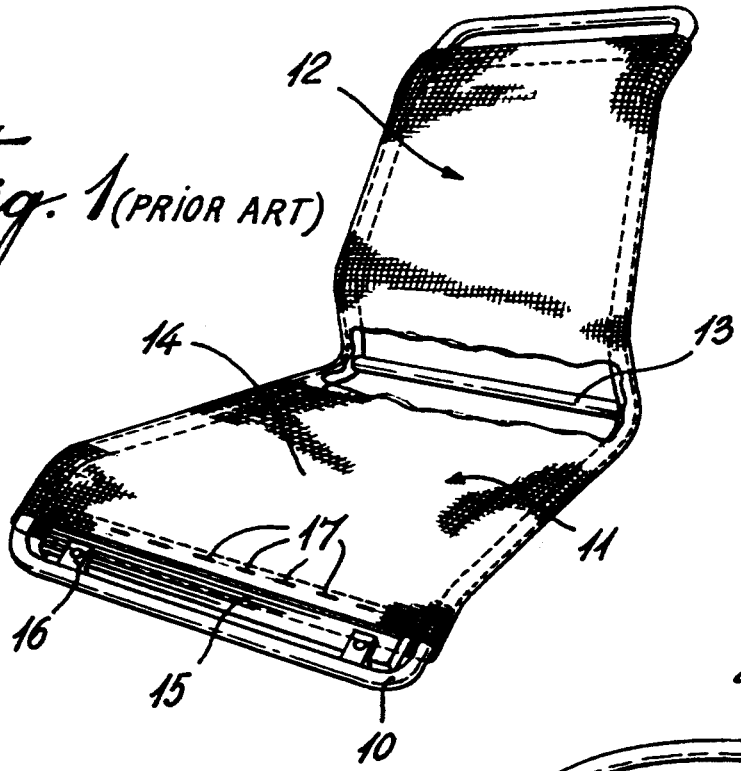
Fig. 1 (PRIOR ART)
FIG. 1 a perspective view of a prior art tubular seating frame structure using a tension bar to retain a sleeve in tension thereabout.

Referring now to the drawings, and more particularly to FIG. 1, there is shown a tubular composite support frame structure of the prior art and comprised of a tubular frame 10 forming a seating portion 11 and a backrest portion 12. A tensioning bar 13 spans the frame 10 between the seat and backrest portions with the sleeve thereabout to apply lateral tension to the frame to place the sleeve 14, positioned over the frame, under tension. Attaching wooden elements 15 are retained by brackets 16 so that fasteners 17 will secure the sleeve 14 to the frame 10 to prevent it from slipping and also helps to keep the sleeve in tension. The sleeve 14 is positioned over the frame before the tension bar is placed in position. The jacket or sleeve 14 may be made in two sections, one for the seating section, and the other for the backrest section, with both sections being secured to a wooden bar 15 or other attaching elements to prevent slippage of the sleeves. These sleeves are usually constructed of knitted polyethylene fibers. Some of the problems encountered with this type of structure is that it is time-consuming to fabricate and requires the positioning of a tension element by pulling the frame outwardly to place the frame in tension and to stretch out the sleeve(s). It is also necessary to secure the sleeve(s) to the frame to prevent displacement thereof.

Referring now to FIGS. 2 to 5, there is shown the composite support frame 20 of the present invention as used to fabricate a seating structure shown at 19 and a backrest structure as shown at 18. The composite support frame structure 20 of the invention is formed from a rigid continuous rod-like member, such as a hollow tubular metal member 21, solid core rod or other rod-like member capable of being placed in compression to exert a restoring force, and formed in a closed loop. The frame has opposed side frame members 22 which lie in a common plane. The side members 22 diverge towards a common end, herein the rear end 23 for the seating structure 19, and the top end 24 for the backrest structure 18. Seeing that the backrest structure 18 is substantially the same as the seating structure 19, only the seating structure construction will be described in detail herein.

A first intermediate rod-like end member 25, herein the rear end member, is formed integral with the side members 22 and disposed in the same plane. The forward end intermediate tubular member 26 is also formed integral and has a curved forward end portion. The side members 22, as shown more clearly in FIG. 5, have a curved forward end portion 27, whereby the front end portion 26 of the rod-like member 21, lies in a plane below the common plane of the side members 22. This prevents clearance from the web or sleeve so that a person sitting on a chair formed with the frame will not have any contact with the frame, as later described. The periphery of the frame, as better seen in FIG. 3, is substantially trapezoidal with rounded corners 9.

Figure 2:
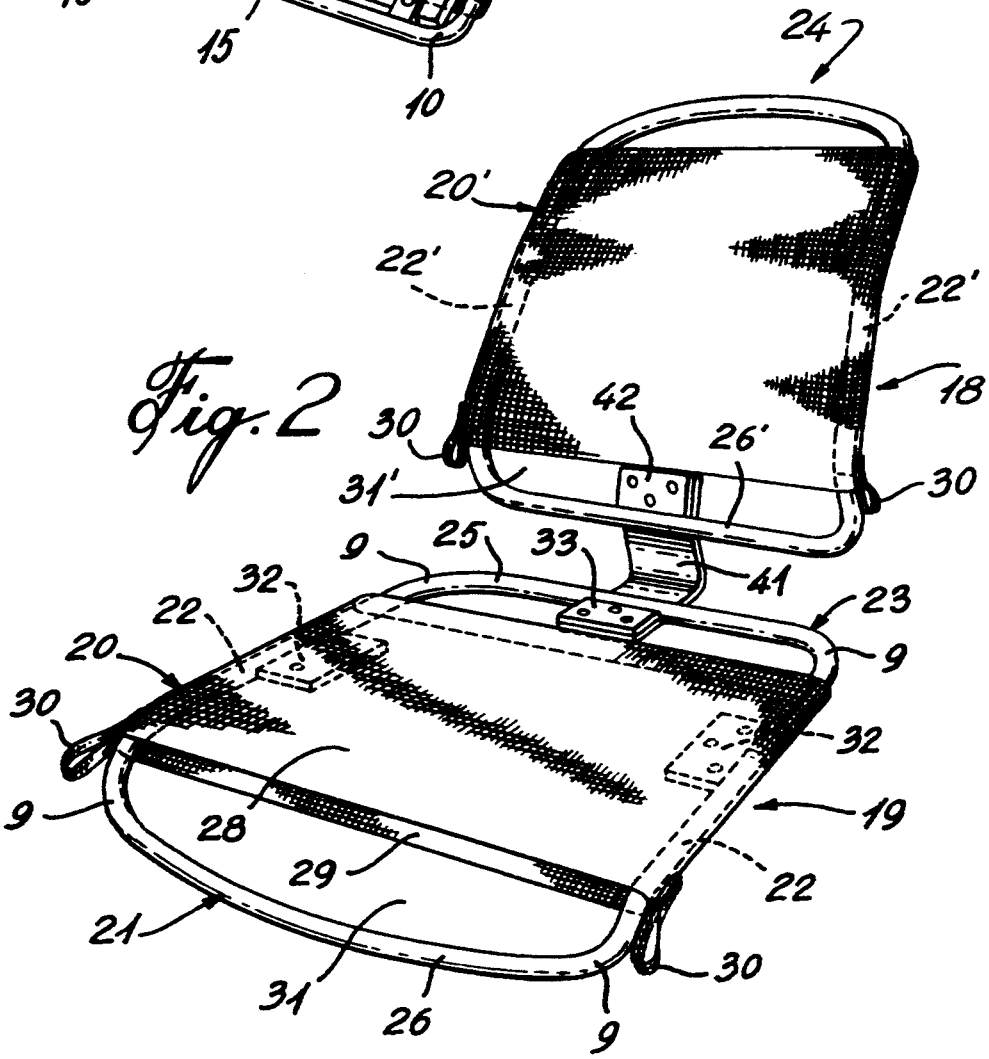
FIG. 2 is a perspective view showing the construction of the rod-like composite support frame structure as used for a chair seat and backrest.
Figure 3:
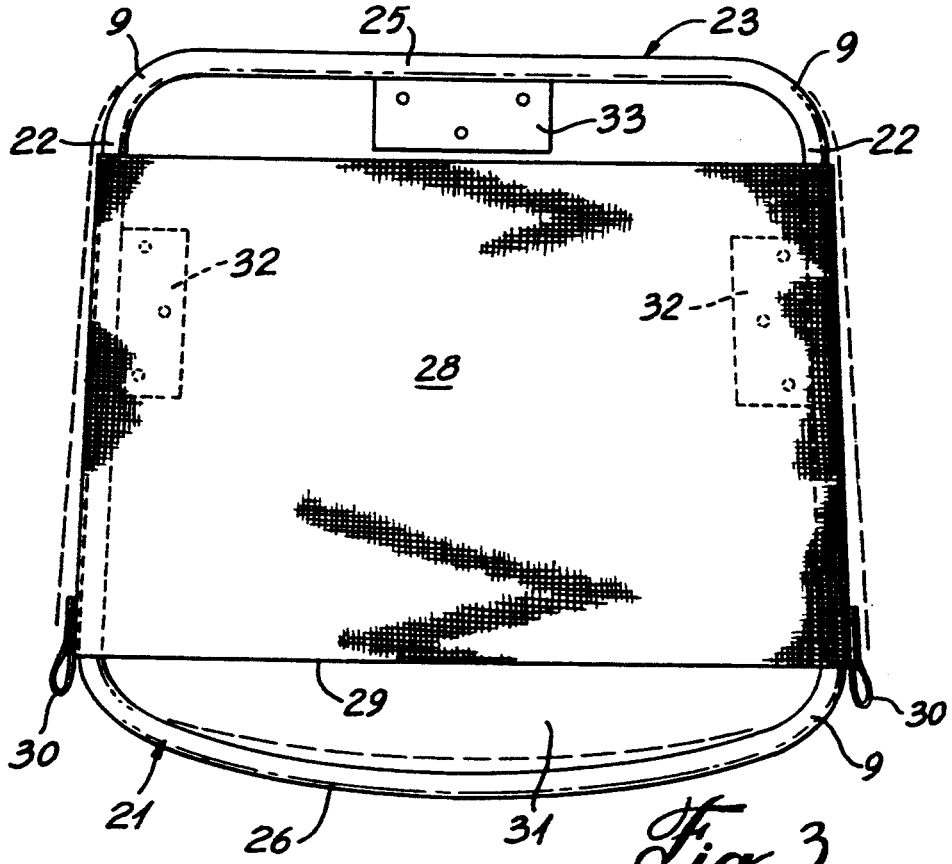
FIG. 3 is a top view showing the tubular composite support frame structure of the present invention for use is a seating structure.

A belt 28 of substantially non-extensible material, such as a sleeve of woven polyethylene fibers, having a slightly truncated or substantially trapezoidal shape, as shown in FIG. 3, is slid over the frame 21 with the front end 29 of the sleeve entering the rear end 23 of the tubular frame 21. The inner area of the sleeve is slightly smaller than the width of the tubular frame 21 as measured across the side members 22 and at its position of use, as shown in FIGS. 2 and 3 whereby to compress or load the frame. Therefore, in order to facilitate inserting the truncated belt or sleeve 28 over the frame 21, there is provided grasping means in the form of fabric loops 30 at opposed forward end regions of the sleeve 28 adjacent the front end or wider end 29 of the sleeve and this facilitates pulling the sleeve about the opposed diverging tubular side members 22 of the frame. The larger end 29 of the sleeve is inserted from the rear end 23 of the frame and pulled thereover to a predetermined position where the sleeve spans the open area 31 of the tubular frame 21. The knitted fabric also provides good frictional contact with the frame side members to aid in preventing slippage.

As the sleeve is pulled to its final position, as shown in FIGS. 2 and 3, the sleeve will apply a compression force against the side members 22, causing the frame to be placed in compression whereby the tubular or rod-like side members 22 will exert a continuous restoring force on the sleeve 28 which is formed of substantially non-extensible fibers, thereby maintaining the sleeve under tension and in position. The polyethylene fibers utilized for the sleeve have a low modulus of elasticity whereby to substantially resist stretching of the sleeve when the frame is in compression inside the sleeve.

The rod-like frame 21 is further provided with attachment means in the form of connecting brackets 32 secured to the side members 22 and extending in the common plane of the side members and in the open area 31. A further connecting bracket 33 is secured to the rear end transverse member 25 and also extends in the plane of the side members and within the open area 31. The brackets 32 may also serve as armrest attachments or for connection to different chair bases. The bracket 33 is for attaching the backrest 18.

Figure 4:
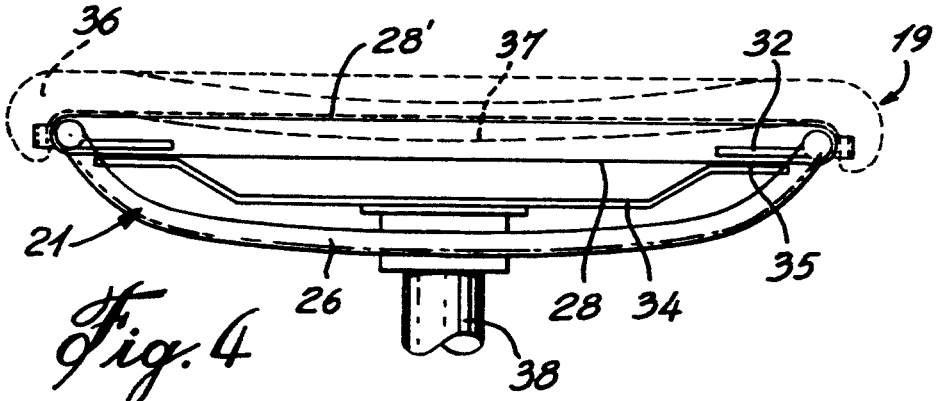
FIG. 4 is a front view of FIG. 3.

As shown in FIG. 4, the brackets 32 secure a seat attachment member 34 under the seat structure 19. The attachment member 34 is formed as a flat steel bar of shallow U-shaped form and having opposed elevated connecting wings 35 for attachment to the brackets 32 by means of bolt fasteners (not shown). The shallow U-shaped bar 34 prevents obstruction to the belt or sleeve 28 positioned about the frame 21 when a load (i.e. a person) is positioned on top of the belt 28. A padded foam cover structure 36 is secured over the tubular frame 21 and the belt 28 and the belt upper run 28' will flex when a load is applied thereto, as shown in phantom lines at 37 in FIGS. 4 and 5. With the present frame structure, a person is suspended on the belt and does not contact any solid objects. The ischium bone structure of the person is therefore not aggravated.

Figure 5:
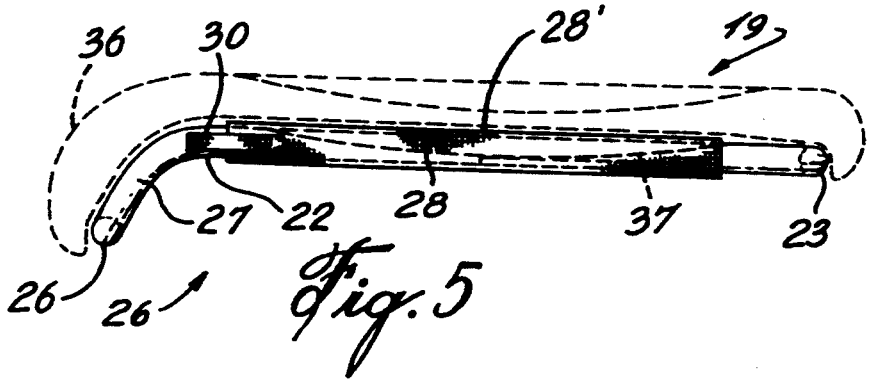
FIG. 5 is a side view of FIG. 3.
Figure 6A:
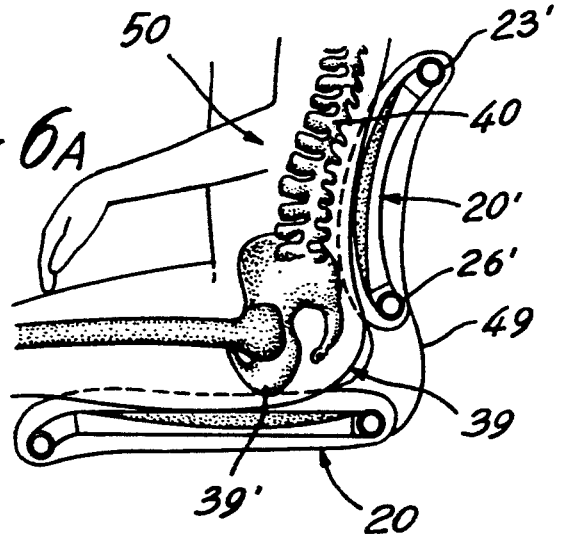
FIGS. 6A and 6B are side and front views showing a chair constructed with the tubular composite support frame structure of the present invention and its response to a person seated thereon and illustrating the response of the web to the load applied thereto.

The seat attachment member 34 also provides connection for different chair mechanisms (not shown) or a support post 38, usually connected to displaceable or fixed leg structures through an adjustable hub (not shown) As further shown FIG. 5, the downward curve 27 of the side members 22 in the front end 26 of the frame provides a smooth curvature for the front end of the seat structure 19 and proper support so that a person is caused to sit squarely on the chair with the buttocks 39 in the proper rearward position and the spinal cord 40 supported upright thereabove, as shown in FIG. 6A. The person's legs will also not contact front downwardly curved member 27 and front end member 26 due to its low position, as shown in FIG. 5.

Referring again to FIG. 2, there is shown two composite support frame structures 20 forming the seating and backrest structures 19 and 18 respectively of a chair. The backrest structure 18 is held in position by an attachment bar 41 which is constructed of rigid material and which connects to the connecting bracket 33 of the intermediate member 25 in the rear end of the seating structure 19. The other end of the attachment bar 41 connects to a further connecting bracket 42 of the backrest which is secured to the lower end tubular frame 26' of the backrest composite frame structure 20'. As also shown in FIG. 2 and FIG. 6A, the backrest frame structure has its opposed side members 22' bent at both ends to provide the curvature as shown in FIG. 6A for proper support to the back of a person 50 seated on the chair formed with the structural frames and also to position the end members 23' and 26' out of plane of the side member to eliminate solid contact with a person sitting on the chair.

A padding 49 is secured over the top run of the sleeve and top parts of the frame and may be positioned between the runs of the sleeve or woven inside the top run of the sleeve.

Figure 6B:
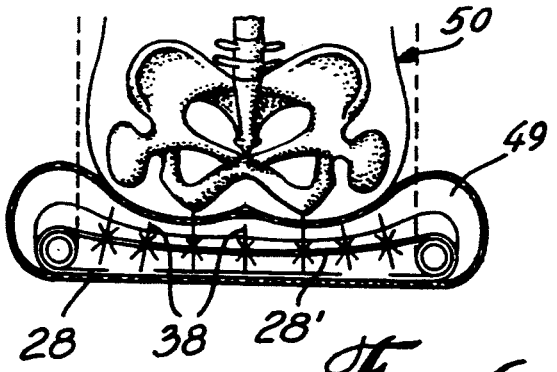

Referring additionally to FIGS. 6A and 6B, the support frame structures 20 and 20', interconnected together as shown in FIG. 2, may separately or in a combined fashion be covered with a foam and fabric covering 49 in a manner well known in the art. When a person 50 sits on the padding or covering 49, the weight of the person will be applied against the top run 28' of the belt 28 causing the top wall to flex downwardly and offer shaped support to the buttocks 39 of the person and avoiding the ischium bone 39' from contacting any solid structure of the frame or structure secured to the frame. Simultaneously, this downward force, as indicated by arrows 38, applies a pulling force or a tension force in the belt, placing more compressive load within the frame and providing a stronger retention force to the belt, thereby preventing the belt from movement. It can be appreciated that with this type of frame construction, it is not necessary to provide any tension bar nor any securement of the belt or sleeve to attachments which would otherwise have to be fastened to the frame. Therefore, the construction of the frame is less expensive, and easier and less time-consuming to assemble.

Figure 7:
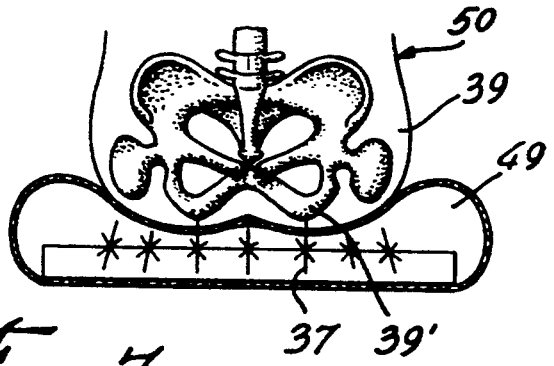
Fig. 7 (PRIOR ART)
FIG. 7 is a view similar to FIG. 6B but of a rigid prior art seating structure.

FIG. 7 illustrates a prior art support frame wherein the frame is rigid. As can be seen, when a person 50 sits on the cushioning material 49, the material will compress under the buttocks in the area of the ischium bone 39' and an upward resisting force 37 will be sensed by the person 56 providing discomfort, particularly after an extended period of time.

It is also pointed out that the closed loop rigid tubular frame and belt structure as defined herein lends itself to the construction of jigs wherein the assembly of these frames may be substantially automated. For example, the frame 21 may be positioned in a jig and the loops 30 of the sleeve engaged by pulling hooks which, when activated, will pull the sleeve over the frame a predetermined distance, thus ensuring an exact placement of the sleeve over the frame and placing the frame under compression to apply a restoring force against the sleeve to maintain the sleeve in tension and in position. The friction between the material of the sleeve and the tubular members is such that there is a good resistance to slippage and further, when a load is applied on the belt, the compression force and restoring force increases, making it more difficult for the belt to be displaced.

As further illustrated, the closed loop frame is provided with rounded corners as designated by reference numeral 9, and together with at least one of the intermediate members 21 and 25 being arcuately formed or having a curvature, favors the restoring spring force of the frame, thereby exerting a lateral force when the belt or sleeve 28 is positioned thereabout. The curved end sections of the side members 22 also assist in maintaining the belt or sleeve 28 in position about the frame. The closed loop 20 and 21 may be constructed of steel or aluminum tubing or any other type of rod or tube capable of providing a restoring force when subjected to compression by the sleeve 28.

It is within the ambit of the present invention to cover any obvious modifications of the preferred embodiment described herein, provided such modifications fall within the scope of the appended claims.

I claim:

1. A frame composite support structure for the construction of a seat, said support frame structure comprising a rigid continuous rod-like frame formed in a closed loop and having opposed diverging side members lying in a common plane, said side members diverging towards a common end, a first intermediate end member formed integral at one end of said opposed side members, a second intermediate end member formed integral at an opposed end of said opposed diverging side members, at least one of said first and second intermediate end member having an outward arcuate shape to provide a restoring spring force in the frame when said diverging side members are compressed towards one another, and a belt of substantially non-extensible material forming a slightly truncated sleeve slightly smaller than the width of said rod-like frame disposed about said opposed diverging side members and spanning at least a portion of an open area defined inwardly of said frame, said sleeve when in position about said frame applying a compression force against said side members to flex said one of said first and second intermediate end member which is arced to apply a continuous restoring spring force in the frame between said side members to retain said sleeve in position by continuous tension.

2. A composite support frame as claimed in claim 1, wherein said opposed end of said side members having a curved end portion whereby said second intermediate end member lies in a plane below said common plane.

3. A composite support frame as claimed in claim 2, wherein said frame is provided with attachment means for attaching same to another structure.

4. A composite support frame as claimed in claim 3 wherein said support frame is a seating frame for a chair, said attachment means is comprised by connecting brackets secured to said side members and extending in said common plane and in said open area.

5. A composite support frame as claimed in claim 4 wherein there is further provided a seat attachment member secured across said connecting brackets, said brackets being aligned with one another, said attachment member being a shallow U-shaped member with opposed elevated connecting wings for securement to a respective bracket, said shallow U-shaped member preventing obstruction to said belt when a load is applied on a top run of said belt.

6. A composite support frame as claimed in claim 5 wherein a further connecting bracket is secured to said first intermediate end member which forms a rear edge of said seating frame and also extends in said common plane and in said open area, a further one of said composite support frame structures also having a connecting bracket secured to said second intermediate end member which forms a lower edge of a backrest frame and extending in said common plane and in said open area, said connecting brackets of said first intermediate end member and of said lower edge of said backrest being interconnected by an attachment bar.

7. A composite support frame as claimed in claim 6 wherein said seating frame and said backrest frame are provided with a support pad structure secured to said sleeve and said frame on a top surface portion thereof.

8. A composite support frame as claimed in claim 2, wherein said belt is provided with grasping means at opposed forward end regions thereof adjacent a wider end of said truncated sleeve for pulling said sleeve about said opposed diverging tubular side members from a narrow end thereof to place said frame under tension.

9. A composite support frame as claimed in claim 8, wherein said belt is woven from synthetic plastic material having a low modulus of elasticity to substantially resist stretching of said belt when said frame is placed in compression by said belt.

10. A composite support frame as claimed in claim 8, wherein said support frame is a seating frame for a chair.

11. A composite support frame as claimed in claim 10, wherein said second intermediate end member is a forward end of said frame.

12. A composite support frame as claimed in claim 8, wherein said support frame is a backrest frame for a chair.

13. A composite support frame as claimed in claim 12, wherein said second intermediate end member is a bottom end of said frame.

14. A composite support frame as claimed in claim 13, wherein said first intermediate end member is a top end of said frame, said diverging common end of said side members having a curved end portion with said first intermediate end member being outwardly curved and lying in a plane below said common plane on the same side as said second intermediate end member.

15. A composite support frame as claimed in claim 8 wherein said grasping means are loops secured to said sleeve and extending forwardly of a forward edge of said sleeve, said forward edge being wider than a back edge of said sleeve.

16. A composite support frame as claimed in claim 1 wherein said rigid continuous frame is formed from a hollow metal rod.

17. A composite support frame as claimed in claim 16 wherein said frame and said sleeve are of substantially trapezoidal shape.

18. A method of constructing a seating structure comprising the steps of:

i) providing a composite support frame structure formed by a rigid continuous rod-like frame defining a closed loop and having diverging side members and transverse end members, said frame being a substantially trapezoidal-shaped frame, at least one of said transverse end members having an outward arcuate shape to provide a restoring spring force in said support frame structure when said diverging side members are compressed towards one another, and ii) positioning a belt of substantially non-extensive material forming a slightly truncated-shaped sleeve about said side members and spanning at least a portion of an open area defined inwardly of said frame, said sleeve being slightly smaller than the width of said support frame structure whereby said side members are placed in compression towards one another by said sleeve when positioned thereabout to flex said one of said first and second intermediate end members which is arced to apply a continuous restoring spring force in the support frame structure between said side members to maintain said sleeve stretched and substantially immovable across said open area by said continuous restoring spring force.

19. A method as claimed in claim 18 wherein said belt is provided with grasping means in opposed forward end regions of said loop adjacent a wider end of said sleeve, said step (ii) comprising (a) inserting said wider end of said sleeve from a narrower end of said trapezoidal frame, and (b) pulling said sleeve over said side members by said grasping means to place said side members in compression to cause said arced one of said transverse end members to exert said continuous restoring spring force.

20. A method as claimed in claim 19 wherein there are two of said composition support frame structures, one of said structures being a seat structure and the other a backrest structure, there being provided the further step of interconnecting said two structures together by an attachment bar to retain them in spaced relationship.

* * * * *